US005658029A

United States Patent [19]

Franko

[11] Patent Number: 5,658,029

[45] Date of Patent: Aug. 19, 1997

[54] HAND-SAVER FOR PLASTIC SHOPPING BAGS

[76] Inventor: Terry L. Franko, P.O. Box 24747, Wilson Point Rd., Baltimore, Md. 21220

[21] Appl. No.: 533,388

[22] Filed: Sep. 25, 1995

[51] Int. Cl.[6] ..... A45C 13/26

[52] U.S. Cl. ..... 294/171; 294/137

[58] Field of Search ..... 294/137, 165, 294/166, 170, 171; 229/117.19, 117.23, 117.24, 117.25; 383/6, 13, 25, 29; 16/114 R, 114 B; D9/434

[56] References Cited

U.S. PATENT DOCUMENTS

| | | | |
|---|---|---|---|
| D. 268,815 | 5/1983 | Schwalbach . | |
| 1,079,527 | 11/1913 | Wallace . | |
| 1,492,100 | 4/1924 | Krueger . | |
| 1,524,399 | 1/1925 | Krueger . | |
| 2,215,116 | 9/1940 | Crary | 294/171 |
| 2,677,369 | 5/1954 | Knowles . | |
| 2,778,555 | 1/1957 | Poryle . | |
| 3,031,359 | 4/1962 | Blank et al. . | |
| 3,153,507 | 10/1964 | House . | |
| 3,301,452 | 1/1967 | Jester . | |
| 3,339,824 | 9/1967 | Luke . | |
| 3,548,906 | 12/1970 | Murphy . | |
| 4,112,541 | 9/1978 | Tetradis . | |
| 4,385,690 | 5/1983 | Olsen . | |
| 4,520,924 | 6/1985 | Edwards et al. . | |
| 4,590,640 | 5/1986 | Enersen | 294/171 |
| 4,666,203 | 5/1987 | Castro . | |
| 4,772,133 | 9/1988 | Volk . | |
| 4,796,940 | 1/1989 | Rimland . | |
| 4,818,121 | 4/1989 | Volk . | |
| 4,923,235 | 5/1990 | Stewart . | |
| 4,946,065 | 8/1990 | Goulter et al. . | |
| 4,982,989 | 1/1991 | Sweeny . | |
| 4,991,894 | 2/1991 | Rutens . | |
| 5,005,891 | 4/1991 | Lunsford . | |
| 5,026,105 | 6/1991 | Feldman . | |
| 5,150,938 | 9/1992 | Gans . | |
| 5,181,757 | 1/1993 | Montoya . | |
| 5,199,758 | 4/1993 | Howell . | |
| 5,263,755 | 11/1993 | Thompson . | |
| 5,356,190 | 10/1994 | Torres . | |
| 5,411,307 | 5/1995 | Roberts . | |

FOREIGN PATENT DOCUMENTS

| | | | |
|---|---|---|---|
| 2135179 | 8/1984 | United Kingdom | 294/171 |

*Primary Examiner*—Dean Kramer
*Attorney, Agent, or Firm*—Alvin Isaacs

[57] ABSTRACT

Device for carrying shopping bags having a handle for gripping in the palm of the hand for carrying; and a sheet material blank for forming same. The blank is generally elliptical-shaped, rounded in the middle and tapering toward each end and has a pair of centrally disposed parallel fold lines for dividing the blank into a pair of asymmetrical sides. One of these sides has a portion defined by a fold line along a base edge and score lines along opposed side edges connected to the base edge and a top edge connected to the side edges which when broken free at the score lines and folded along the fold line forms a locking tab having notched edges, the other side having a trapezoidal-shaped portion defined by a fold line along its base edge and score lines along its other edges and which when broken away along its score lines and folded along its fold line provides an open locking slot mating with the tab when the blank is folded to provide the respective two sides so that when the tab is inserted within the slot, its notches engage the side edges of the slot to releasably secure the two sides together. In use, the device is wrapped around the bag handle, and thereafter the tab is inserted in the slot to pull the two sides of the bag towards each other and to releasably secure the device to the bag.

11 Claims, 4 Drawing Sheets

FIG. 2.
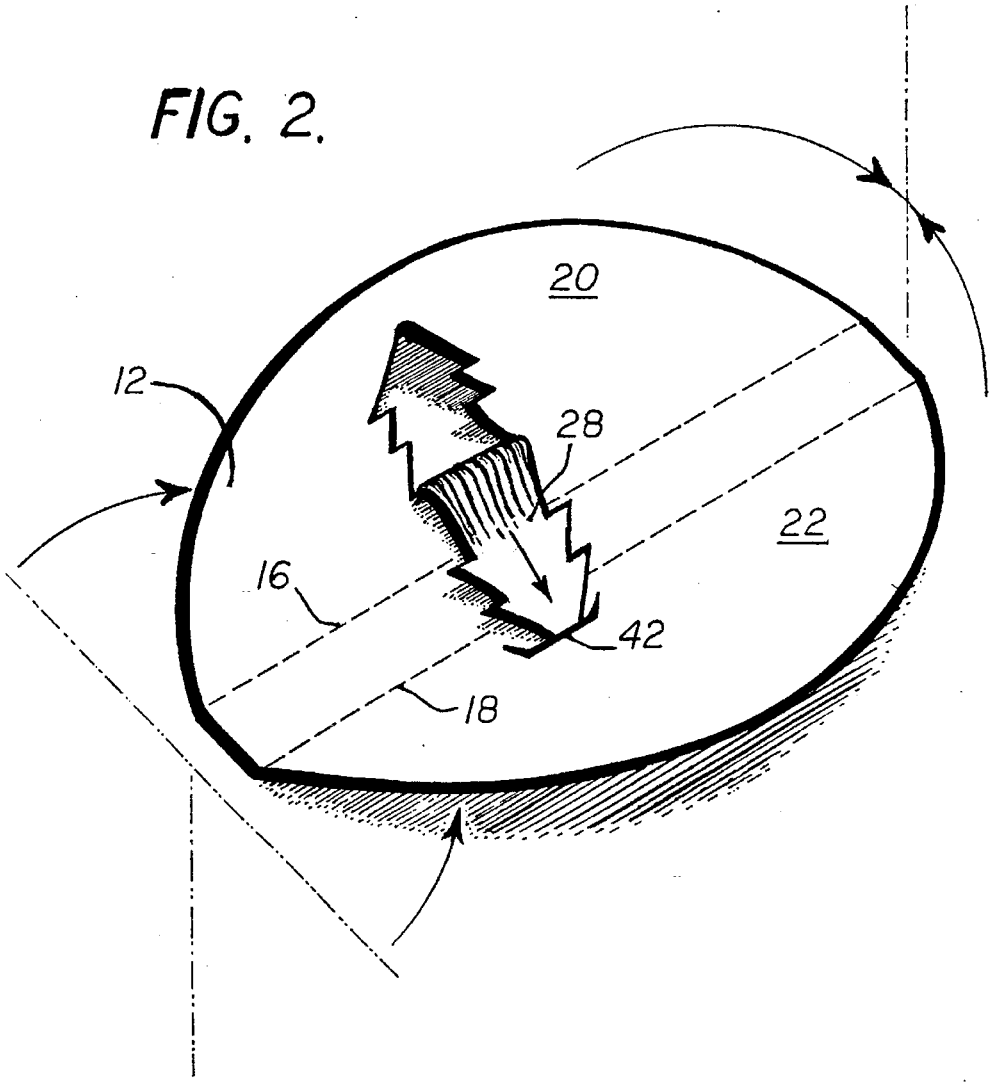
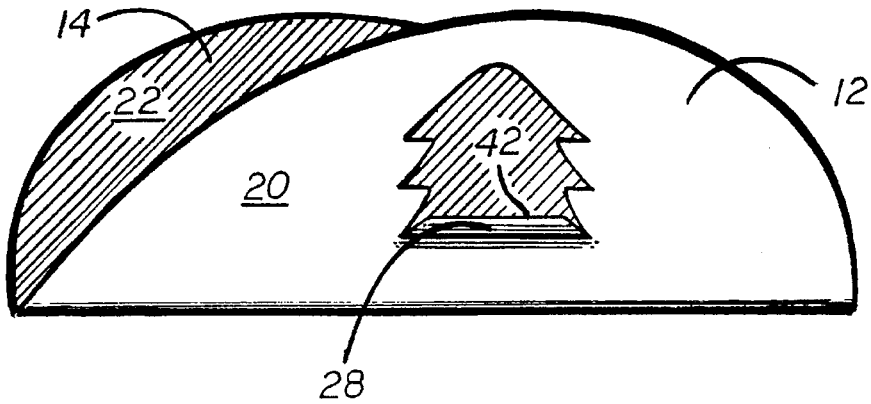
FIG. 3.

HAND-SAVER FOR PLASTIC SHOPPING BAGS

BACKGROUND OF THE INVENTION

The present invention relates to disposable handle devices for facilitating carrying of one or more laden plastic shopping bags or the like of the type having a handle which can be gripped in the palm if the hand for carrying; and to a sheet material blank or form for preparing same. Per se known device of this description, e.g. the plastic bags commonly found in retail stores such as food markets are easy to carry if the contents are not too heavy, in which case the handle tends to dig into one's palm, causing discomfort. Moreover, as will be readily understood by frequenters of food stores who load their plastic carrying bags into the trunk or back seat of their cars for the trip home, there is a great tendency for at least some of the contents of the bags to spill out during transit.

Consequently, the patent literature is replete with patents for devices which will slip through and releasably engage the bag handle to facilitate carrying. While not intended to be a full survey of this patent literature, the following U.S. Pat. Nos. may be taken as illustrative: 1,079,527; 1,492,100; 1,524,399; 2,677,369, 2,778,555; 3,153,507; 3,301,452; 3,031,359; 3,339,824; 3,548,906; 4,112,541; 4,385,690; 4,666,203; 4,520,924; 4,772,133; 4,796,940; 4,818,121; 4,923,235; 4,946,065; 4,982,989; 4,991,894; 5,026,105; 5,005,891; 5,150,938; 5,181,757; 5,263,755; 5,199,758; 5,356,190; 5,411,307; and Design U.S. Pat. No. 268,815.

From the foregoing list, it will thus be seen that there is constant effort for providing an improved handle device for carrying these plastic bags. It is also apparent that at least the respective patentees do not feel that the optimum device has yet been conceived.

The present invention is directed not to just another handle device, but to one the Applicant believes to be an improvement over those of the prior art.

Stated simply, the task of this invention is to provide a carrying device of the foregoing type which is economically feasible to make in large quantities, can be provided in cartons containing large quantifies of blanks or forms for preparing the handle devices, and accomplishes its functions as a hand-saver carrying the loaded bags and also to retain the mouth of the bag secured so as to minimize if not inhibit altogether spillage of its contents.

BRIEF DESCRIPTION OF THE INVENTION

In accordance with the present invention, this task is solved in an elegant manner by providing a generally elliptical-shaped blank rounded in the middle and tapering towards each end, the blank having a pair of centrally disposed parallel fold lines which when folded divides the blank into a pair of asymmetrical sides whose peripheries are not in juxtaposition when the blank is folded, one of the sides having a portion defined by a fold line and score lines which when broken free at the score lines and folded at the fold line forms a locking tab or tongue, the other side having a trapezoidal-shaped portion defined by a fold line and score lines and which when broken away along the score lines and folded along the fold line provides an open slot, the slot and tab mating such that when the blank is folded to provide the respective sides, the tab is insertable within the slot, the tab having at least one and preferably two or more sets of toothed projections at its edges providing notches which, when the tab is inserted within the slot, engage the side edges of the slot so as to releasably secure the two sides of the blank together.

In use, the blank is folded along the fold lines, broken away along the score lines to provide the tab and slot, wrapped around the bag handle and thereafter the tab is inserted within the slot to pull the sides of the bag mouth towards each other and to releasably secure the hand-saver device of this invention to the bag.

BRIEF DESCRIPTION OF THE DRAWINGS

FIG. 2 is a perspective view showing the blank of FIG. 1 partially folded with the locking tab for securing the device partially inserted into the mating slot;

FIG. 3 is a side elevational view of the tab inserted within the slot;

DETAILED DESCRIPTION OF THE INVENTION

As was heretofore mentioned, the present invention is directed to disposable handle devices for facilitating carrying of one-or more laden shopping bags or the like of the type having a handle which can be gripped in the palm of the hand for carrying; and to a sheet material blank for forming same.

The invention may best be understood by reference to the following detailed description taken in conjunction with the accompanying illustrative drawings depicting the preferred form of the invention.

Figure 1:
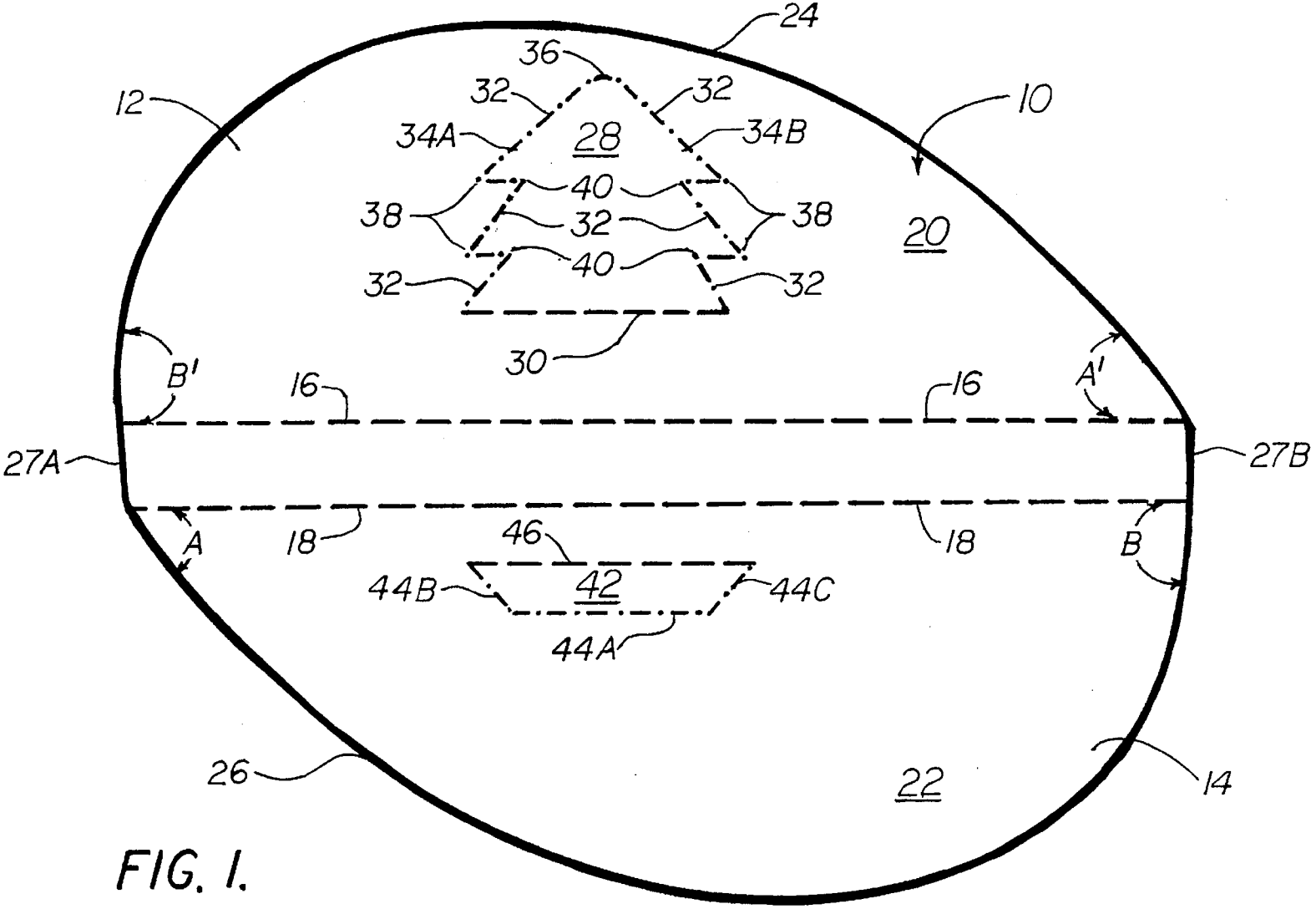
FIG. 1 is a front elevation of the blank of this invention.

With reference in particular to FIG. 1, there is shown a blank or form 10 having a front side 12 and a rear side 14. Blank 10 is made of a semi-rigid flexible material which may be on the order of 2–4 min. thick. In the most preferred embodiment, blank 10 comprises a per se known environment-friendly material, e.g. a biodegradable fiber board or cardboard.

As seen, blank 10 is of a generally elliptical shape, being rounded in the middle and tapering to its ends. Substantially centrally disposed within the blank are a pair of parallel fold lines 16,18 which are separated or spaced apart, e.g. on the order of 0.5 inch along either end of a pair of straight side edges 27*a*, 27*b* of blank 10. As will be discussed in more detail hereinafter, the space defined by ends 27*a*, 27*b* and folds 16 and 18 will provide a comfortable handle to fit within the palm of the hand to carry the bag.

When the blank is folded along fold lines 16 and 18 two asymmetrical sides 20 and 22 are provided. The periphery and thus the shape of side 20 is provided by fold line 16 and arcuate edge 24 joining the fold line 16; while that of side 22 is provide by fold line 18 and arcuate edge 26.

Figure 4:
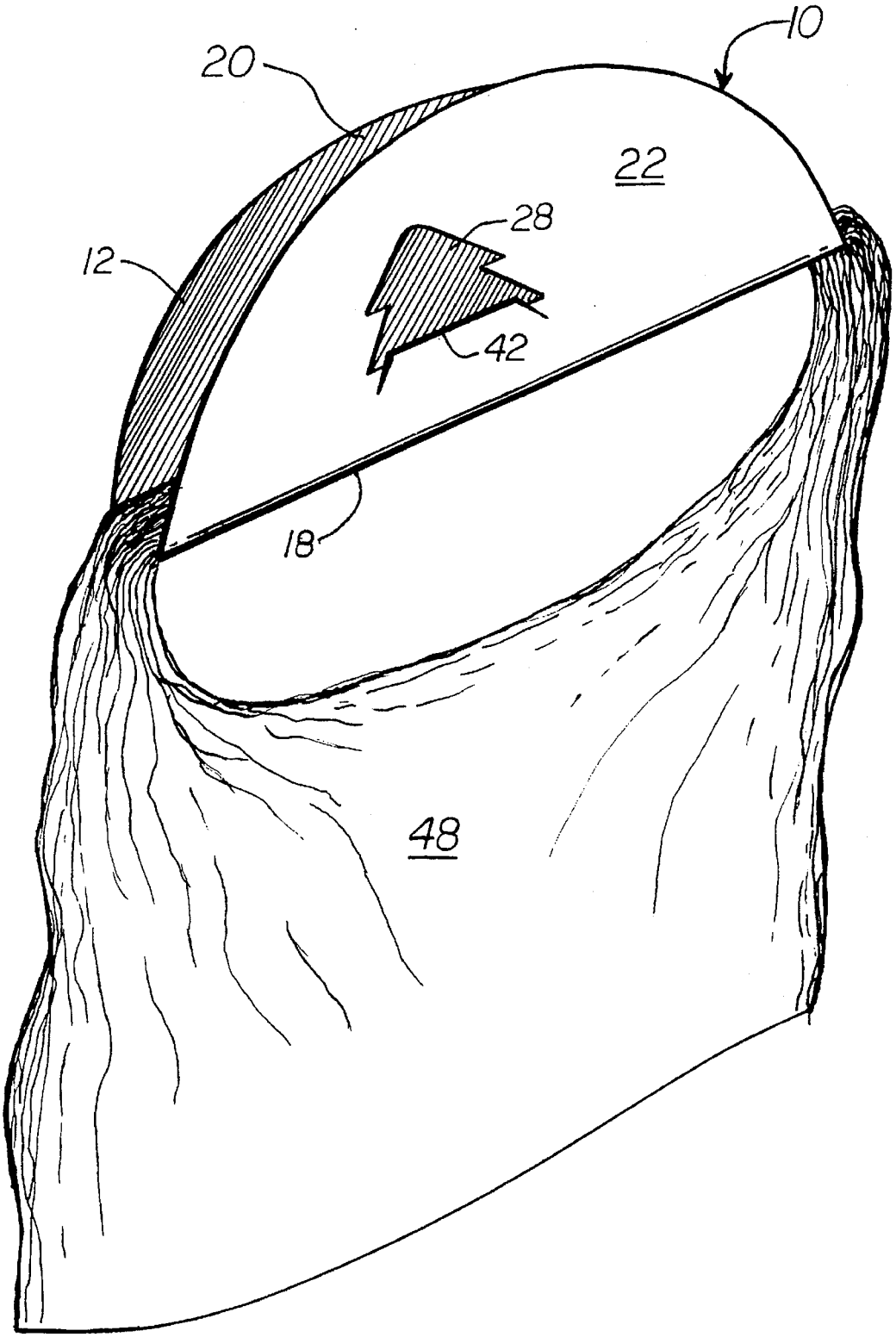
FIG. 4 is a perspective view of the hand-saver device of this invention wrapped around the handle of a shopping bag.

An important feature of the invention is that the two sides are asymmetrical in the sense that their shapes are somewhat different so that, when the blank is folded as described, the arcuate edges 24 and 26 are not aligned in superposition, as seen in FIGS. 3 and 4, so that when engaged on a bag, the fingers can easily grip one of the arcuate sections and the thumb the other arcuate section while the portion between the fold lines fits comfortably in the palm of the hand.

Reference is now made to the locking means for releasably securing the handsaver device of this invention to the handle of a bag.

Side 20 has a locking tab or tongue 28 defined by fold line 30 at the base of the tab and score lines 32 defining the side edges 34*a* and 34*b* and the top portion 36 of the tab. When broken away along the score lines 32 and folded along fold line 30, it will be seen that tab 28 has opposed side edges 34*a* and 34*b*, a base or bottom edge defined by fold line 30 and a head portion 36. Sides 34*a* and 34*b* have at least one pair of toothed projections 38 providing notches 40 for releasably securing the device around a bag, as will be discussed hereinafter. In the preferred embodiment shown in the drawings, two pairs of toothed projections 38 are shown to be provided. In any case, each set of toothed projections consists of a toothed projection on each side edge equidistant from the fold line.

Side 22 has a locking slot in the form of a trapezoid defined in blank 10 by fold line 46 and score lines 44*a*, 44*b* and 44*c*. When broken away along the score lines 44*a,b,c* and folded along fold line 46, a locking slot is formed which mates with tab 28 when the blank 10 is folded along fold lines 16,18 so that the tab 28 can be inserted through the slot.

The dimensions of the slot provided by lines 44*a,b,c* is such that the head portion 36 of the locking tab 28 is easily inserted until one of the set of notches 40 on opposed side edges 34*a* and 34*b* engage the side edges 44*b* and 44*c*, respectively, of the locking slot 42 to releasably secure the tab within the slot. For the tab to engage the side edges of the slot, it will be readily understood that the length of line 44*a* should be just slightly larger than the distance of a line drawn between one set of notches 40 on side edges 34*a*,34*b*, while at the same time the angle between sides 44*b* and 44*a* and that between lines 44*a* and 44*c* is substantially the same as the angle of the toothed projections along side edges 34*a* and 34*b*.

As heretofore mentioned, the locking tab will contain at least one set of toothed projections 38 having notches 40. If only one set is provided, it will be understood that the hand-saver device of this invention can be employed to carry but a single bag.

In the preferred embodiment shown in the drawings, the tab has two sets of toothed projections to accommodate two bags.

As best seen in FIG. 4, in use the hand-saver device is wrapped around a bag 48 and the tab 28 inserted within the slot to releasably secure the device around the bag. As seen therein, the locking tab is secured at the lowermost of the two notches, i.e. the notches closest to the base or fold line 30. If two bags are contemplated, the device will be fitted around the handle of both bags and the locking tab inserted into the slot until the second set of notches, i.e. the set closest to the head portion 36 of the tab, is secured against the slot.

It is also envisioned that if found desirable, the hand-saver device of this invention may be larger to accommodate more than two bags, in which case three or more sets of toothed projections would be provided on the tab.

Figure 5:
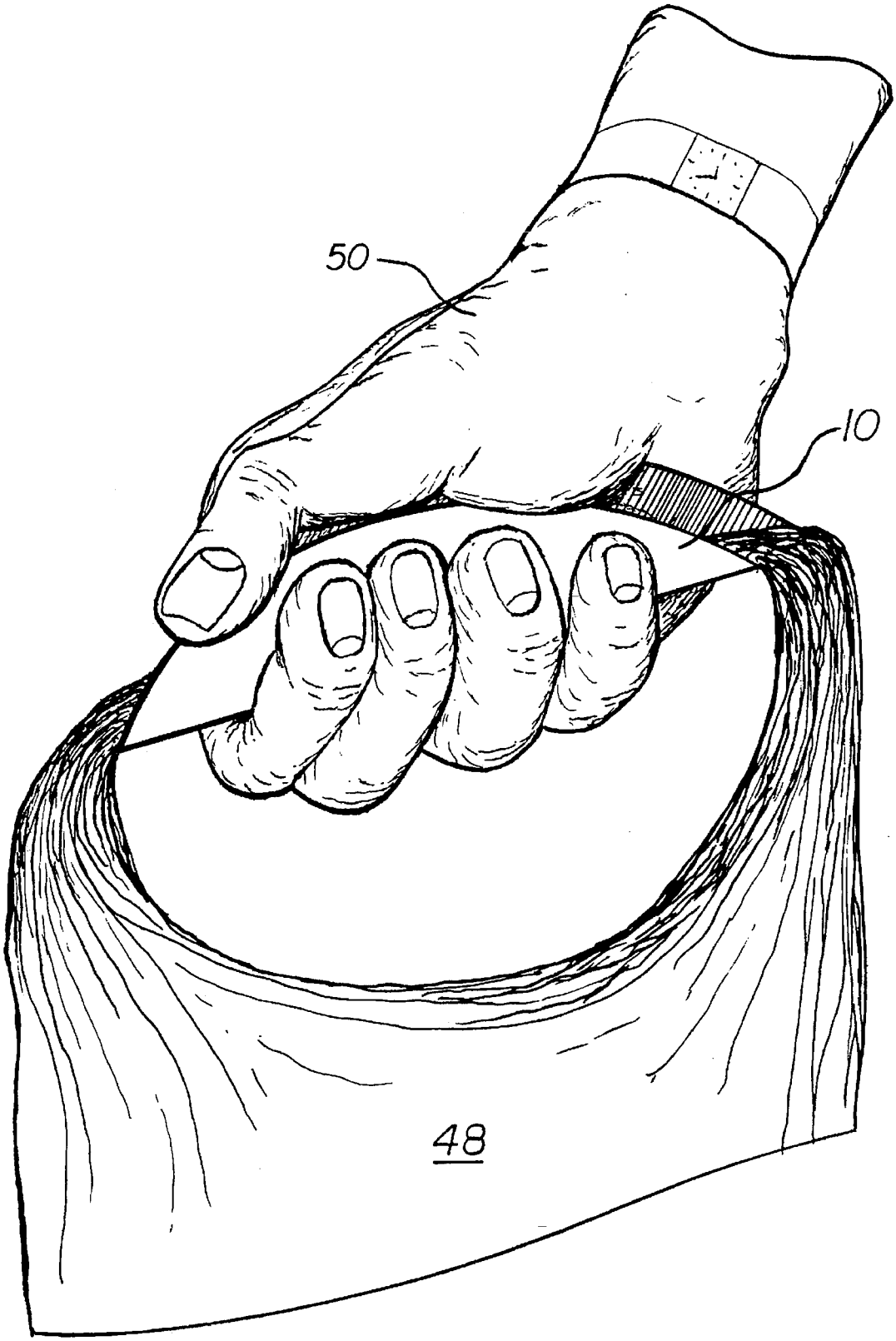
FIG. 5 is a perspective view of the user carrying a shopping bag in accordance with this invention.

As was heretofore mentioned, an important feature of this invention is that the two sides 20,22 are not symmetrical so that the arcuate portion 24 of side 20 is not in superposition with the arcuate portion 26 of side 22, as seen in FIGS. 3–5. Research has shown that with this configuration the device is more comfortably gripped by the hand 50 of a user for handling in the manner shown in FIG. 5.

The blanks of this invention can be readily manufactured by mass production techniques such as those per se known in the art and then packaged and shipped in large quantities for distribution and sale.

As will be appreciated, they may also be provided with suitable printing or art work and employed for promotional or advertising purposes as give-away to potential consumers.

Since certain changes may be made without departing from the scope of the invention herein contemplated, it is expressly understood that the foregoing description and the accompanying drawings should be taken as illustrative and not in a limiting sense.

What is claimed is:

1. A blank for forming a handle device to facilitate carrying a shopping bag of the type having a handle to be gripped in the palm of the hand, the blank comprising:

a generally elliptical-shaped sheet of semi-rigid flexible material being rounded in the middle and tapering towards each end, the sheet material having a pair of centrally disposed parallel fold lines which when folded divide the blank into two an asymmetric pair of adjacent sides, one of the sides having means for forming a locking tab;

the other side having means for forming a locking slot, the locking tab and locking slot mating with one another so that when the blank is folded along the parallel lines to divide the blank into the two adjacent sides, the locking tab is inserted within the locking slot, thereby to releasably secure the two sides together.

2. A blank as defined in claim 1 wherein the material forming the blank is biodegradable.

3. A blank as defined in claim 1 wherein each of the sides formed by folding along a fold line has an arcuate edge connected to the fold line, the opposed arcuate edges not being in juxtaposition when the blank is folded along the fold lines.

4. A blank for forming a handle device to facilitate carrying a shopping bag of the type having a handle to be gripped in the palm of the hand, the blank comprising:

a generally elliptical-shaped sheet of semi-rigid flexible material being rounded in the middle and tapering towards each end, the sheet material having a pair of centrally disposed parallel fold lines which when folded divide the blank into an asymmetric pair of adjacent sides, each having an arcuate edge connected to one of the folded edges, the opposed arcuate edges of the asymmetric sides not being in juxtaposition when folded;

one of the sides having a portion defined by a base fold line, score lines defining side edges of the portion extending from either side of the fold line, and score lines defining a top edge connecting the side edges, the side edges tapering outwardly from the top score line to the base fold line, the portion forming a locking tab extending from the base fold line when the portion is broken free at the score lines;

the other side of the blank having a trapezoidal-shaped portion defined by a base fold line, score lines defining side edges of substantially equal length extending from the base fold line and joined by a score line substantially parallel to the base line and which when broken free along the score lines and folded along the fold line provides an open locking slot, the locking slot and tab mating with each other so that when the blank is folded along each of the centrally disposed fold lines to form the two adjacent sides, the locking tab is insertable within the locking slot, the tab having at least one set of toothed projections consisting of a toothed projection on each of the side edges positioned so as to be equidistant from the fold line of the tab, the toothed projections having notches which, when the tab is inserted within the slot will engage the side edges of the slot so as to releasably secure the two sides together.

5. A blank as defined in claim 4 wherein the sheet material forming the blank is biodegradable.

6. A blank as defined in claim 4 wherein each side edge of the locking tab has a plurality of toothed projections having notches which can engage the side edges of the locking slot.

7. A handle device to facilitate carrying a shopping bag of the type having a strap to be gripped in the hand comprising:

a sheet of semi-rigid flexible material being rounded in the middle and tapering towards opposed ends, the sheet being foldable to provide two opposed sides, each having an arcuate edge joining the fold line, the two sides being asymmetrical so that their arcuate edges are not aligned in superposition when the sheet is folded to bring the two sides together;

one of the sides having a locking tab;

the other side having a locking slot adapted for receiving the locking tab, the locking tab and locking slot mating with one another so that when the sheet is folded to bring the two sides together around the bag strap, the locking tab can be inserted within the locking slot to releasably secure the handle device to the bag.

8. A handle device as defined in claim 7 wherein:

the locking tab comprises an upstanding tab having a base folded away from the one side, opposed side edges extending from either side of the base, and a top edge joining the side edges, the side edges being tapered outwardly from the top edge to the base of the tab; and the locking slot consists of an opening in the second side formed by tearing an upstanding flap away from the sheet material on the second side along a fold line.

9. A handle device as defined in claim 8 wherein the locking tab has at least one set of toothed projections consisting of a toothed projection on each of the side edges positioned so as to be equidistant from the tab fold line, the toothed projections having notches; the locking slot is of a trapezoidal configuration in which the base is the fold line, and the upstanding flap consists of side edges of substantially equal length extending inwardly from the base fold to the top edge of the trapezoidal flap, and the handle device is releasably secured to the bag strap by the toothed projections of the tab engaging the side edges of the slot when the tab is inserted within the slot opening.

10. A method of preparing a handle device to facilitate carrying a shopping bag of the type having a handle to be gripped in the palm of the hand, comprising the steps of:

(1) forming a blank comprising a generally elliptical-shaped sheet of semi-rigid flexible material being rounded in the middle and tapering towards each end, the sheet material having a pair of centrally disposed parallel fold lines which when folded divide the blank into an asymmetric pair of adjacent sides; one of the sides having a portion defined by a base fold line, score lines defining side edges of the portion extending from either side of the fold line, and score lines defining a top edge connecting the side edges, the side edges tapering outwardly from the top scorn line to the base fold line, the portion forming a locking tab extending from the base fold line when the portion is broken free at the score lines; the other side of the blank having a trapezoidal-shaped portion defined by a base fold line, score lines defining the side edges of substantially equal length extending from the base fold line and joined by a score line substantially parallel to the base line and which when broken free along the score lines and folded along the fold line provides an open locking slot mating with the locking tab;

(2) folding each of the parallel fold lines of the blank to form the asymmetric pair of adjacent sides;

(3) folding the base fold line and breaking the score lines defining the side edges extending from either side of the score line and the score lines defining a top edge connecting the side edges on said portion of said one side to form the locking tab extending from the base fold line; and (4) folding the base fold line and breaking the score lines of the trapezoidal-shaped portion on said other side to form the locking slot within which the locking tab can be inserted.

11. The method as defined in claim 10 including the steps of engaging the tab and slot around the handle of at least one shopping bag to be carried and thereafter inserting the tab into the slot to secure the handle deuce around the shopping bag handle.

* * * * *